US008418299B2

(12) United States Patent
Thayer et al.

(10) Patent No.: US 8,418,299 B2
(45) Date of Patent: Apr. 16, 2013

(54) METHODS, APPARATUS, AND SYSTEMS FOR CLEANING MEDIA IN PRINTING SYSTEMS WITH CONDUCTIVE CLEANING MEMBERS

(75) Inventors: Bruce Earl Thayer, Spencerport, NY (US); Ellery F. Wong, Rochester, NY (US); John L. Howard, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 115 days.

(21) Appl. No.: 12/911,026

(22) Filed: Oct. 25, 2010

(65) Prior Publication Data

US 2012/0097189 A1 Apr. 26, 2012

(51) Int. Cl.
*A47L 13/40* (2006.01)

(52) U.S. Cl.
USPC ..... 15/1.51; 134/6

(58) Field of Classification Search ..... 15/1.51; 399/343–360, 384; 134/6
See application file for complete search history.

(56) References Cited

U.S. PATENT DOCUMENTS

| | | | | |
|---|---|---|---|---|
| 4,378,610 | A * | 4/1983 | Ermer et al. | 15/1.51 |
| 5,655,204 | A | 8/1997 | Siegel | |
| 5,701,572 | A | 12/1997 | Behe et al. | |
| 7,418,218 | B2 * | 8/2008 | Thayer | 399/101 |
| 8,139,993 | B2 * | 3/2012 | Thayer | 399/353 |
| 2009/0297195 | A1 | 12/2009 | Ferencz, Jr. | |

OTHER PUBLICATIONS

Anthony S. Condello; Fusers, Printing Apparatuses and Methods of Fusing Toner on Media; U.S. Appl. No. 12/262,540, filed Oct. 31, 2008.

Bruce Thayer; "Web Cleaning Systems Including an Electrostatic Cleaning Brush and Methods of Cleaning Printed Webs"; U.S. Appl. No. 12/768,889, filed Apr. 28, 2010.

* cited by examiner

*Primary Examiner* — Laura C Guidotti
(74) *Attorney, Agent, or Firm* — Ronald E. Prass, Jr.; Prass LLP

(57) ABSTRACT

A web cleaning system includes one or more conductive electrostatic cleaning members that may be grounded or electrically biased, and form an electric field. The conductive cleaning member opposes a conductive backing member that may be grounded or electrically biased. The conductive cleaning member contacts the web as it translates through the cleaning system, and charged debris on the web is affected by the electric field formed by the cleaning member.

14 Claims, 6 Drawing Sheets

METHODS, APPARATUS, AND SYSTEMS FOR CLEANING MEDIA IN PRINTING SYSTEMS WITH CONDUCTIVE CLEANING MEMBERS

FIELD OF DISCLOSURE

The disclosure relates to methods, apparatus, and systems for cleaning media in printing systems. The disclosure further relates to using a conductive electrostatic cleaning member to clean printed media in a printing system.

BACKGROUND

Media cleaning problems are common in printing systems. Paper or other media, whether in the form of cut sheets or webs, may require cleaning before printing on its surface. Accordingly, related art cleaning systems are designed to remove fibers and dust on, for example, paper webs as they are fed from rolls into printing presses or other machines that require a clean paper input, before printing on the web. Related art media cleaning technology may use stationary mechanical brushes for cleaning input media to be printed. The mechanical brushes may be used in combination with a vacuum and/or air jet for removing loose fibers and dirt from media prior to printing thereon.

SUMMARY

While related art printing systems clean, e.g., a paper web prior to printing, it may be necessary to effectively clean a web after printing an image on its surface, without damaging the image. For example, related art continuous feed web printing systems may use flash radiant fusing. Radiant fusing fixes high mass toner images to media, but may not fix low density scattered background toner as well. When a printed web exits the printer and is cut to size and run through various finishing equipment, the unfused toner may transfer to the finishing equipment.

Many related art media cleaners may contact media in a manner that is too aggressive for suitable use on printed media. Related art stationary brushes and vacuum systems may minimize damage to printed media, but stationary brushes may quickly become contaminated with toner. To prevent toner that accumulates on stationary brushes from smearing on prints, the press must be shut down, and the brushes cleaned. This process may be time consuming, and can hinder efficient print production.

Methods, apparatus, and systems disclosed herein relate to a conductive cleaning member for cleaning printed media, including paper webs, for improving print quality, minimizing system component contamination, and extending service intervals. Methods, apparatus, and systems may include, for example, a conductive electrostatic cleaning member that attracts or repels, e.g., unfused toner particles while cleaning media. Methods, apparatus, and systems disclosed herein may also be used to clean media prior to printing.

Embodiments of methods include electrically biasing one of a conductive cleaning member and a backing member, each of which are arranged on opposite sides of a media channel defined by first and second portions of a cleaning unit, thereby establishing an electric field. Embodiments of methods may include applying the conductive electrostatic cleaning member to at least one of a first and a second printable surface of a web that translates through the media channel.

Further embodiments of methods may include attracting electrostatically charged toner particles to an electrically biased cleaning member, or a grounded cleaning member opposing an electrically biased backing member. The electrostatically charged toner particles may be, for example, loose toner particles that are a byproduct of printing an image on the web. Embodiments may include retaining the electrostatically charged toner particles on an electrically biased cleaning member, or a grounded cleaning member opposing an electrically biased backing member. The retained particles may be released from the cleaning member at an appropriate time, e.g., at a desired service interval. Alternatively, a cleaning member or opposing backing member may be electrically biased to repel electrostatically charged toner particles from the cleaning member.

Further embodiments of methods include electrically biasing a second conductive cleaning member extending from at least one of a first cleaning unit portion and a second cleaning unit portion. The second cleaning member may be arranged to oppose a first electrically biased cleaning member. An electric field may be created by and between the first biased cleaning member and a triboelectrically charged web, and/or the second biased cleaning member and a triboelectrically charged web. A further embodiment may include applying at least one of the first electrically biased cleaning member and the second electrically biased cleaning member to at least one of a first printable surface and a second printable surface of a web. Yet another embodiment may include applying both the first and the second electrically biased cleaning members to opposite surfaces of the web to accommodate cleaning of both sides of the web.

Embodiments of cleaning apparatus and systems including the same may include a cleaning unit with first and second portions that together define a media channel. Media, such as paper webs for use in continuous feed printing systems, may translate through the media channel. The web may include a first and a second printable surface on which toner may be deposited to form an image. For example, the first printable surface may face the first portion of the cleaning unit, and the second printable surface may face the second portion of the cleaning unit.

At least one cleaning member may extend from at least one of the first and the second portions of the cleaning unit, toward the media channel to accommodate cleaning of a web located within the channel. The cleaning member is conductive, may be connected to a power supply, and may be electrically biased. In alternative embodiments, a backing member may oppose the cleaning member, and may be grounded. Alternatively, the backing member may be electrically biased, while the opposing cleaning member is grounded.

In alternative embodiments, a first cleaning member may extend from a first cleaning portion, and second cleaning member may extend from a second cleaning portion. The first portion and the second portion may be arranged opposite from one another to define therebetween a media channel through which media such as a paper web may translate. The first cleaning member and the second cleaning member may extend toward the media channel. Such an arrangement may accommodate enhanced cleaning of both sides of a web, such as a printed web, and may accommodate simultaneous cleaning of the web.

Exemplary embodiments are described herein. It is envisioned, however, that any system that incorporates features of methods, apparatus, and systems described herein are encompassed by the scope and spirit of the exemplary embodiments.

DETAILED DESCRIPTION

Figure 1A:
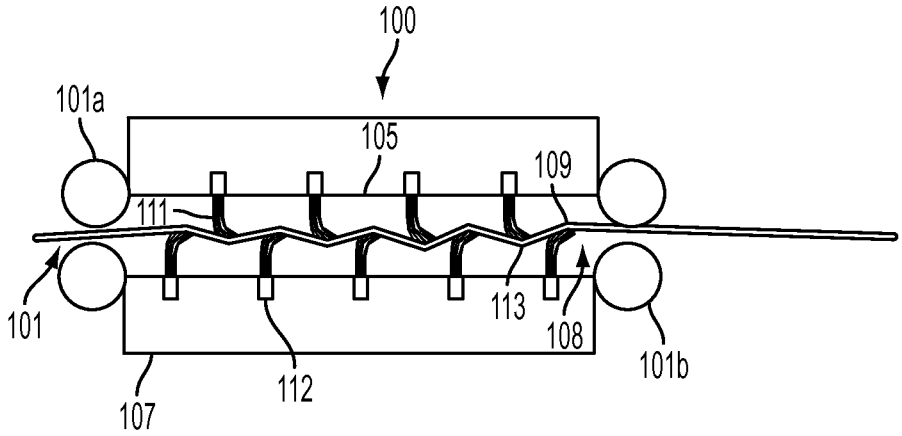
FIG. 1A RELATED ART
FIG. 1A shows a diagrammatical side view of a related art web cleaning unit.

Exemplary embodiments are intended to cover all alternatives, modifications, and equivalents as may be included within the spirit and scope of the methods, apparatus, and systems as described herein.

Reference is made to the drawings to accommodate understanding of methods, apparatus, and systems for cleaning media with conductive electrostatic cleaning members. In the drawings, like reference numerals are used throughout to designate similar or identical elements. The drawings depict various embodiments and data related to embodiments of illustrative methods, apparatus, and systems for cleaning media with conductive electrostatic cleaning members.

A web for printing, typically a paper web, may be cleaned on one side or on both sides simultaneously. Cleaning members, such as stationary fiber brushes or other materials or structure suitable for cleaning media, may dislodge contaminant particles from the web. The dislodged particles may then be transported away from the web by, for example, cross-web air flow. This may accomplished by passing the web between one or more sets of stationary fiber brushes and applying cross-web air flow. Contaminant particles entrained in the air flow may be removed by passing the air flow though an air filter, which may include a coarse particle filter and a fine particle filter.

The cleaning member, e.g. stationary brushes, may be adjustable to provide more or less penetration into a tensioned web. Generally, greater penetration generates greater scrubbing forces across the surface of the web and dislodges material more aggressively. The stationary brush material and density may be varied to change the amount of force and the number of fibers that contact the web. For example, related art animal hair brushes may be made of horsehair or boar's hair. Boar's hair is typically stiffer and less dense than horsehair and therefore has a cleaning effectiveness that differs from that of horsehair. Related art cleaning members may be suitable for cleaning input media prior to printing.

FIG. 1A shows a related art media cleaning system. A related art media cleaning system may include a cleaning unit 100. The cleaning unit 100 may include media passageways 101 defined by rotatable or stationary members such as passageway rolls 101*a* and passageway rolls 101*b*. Cleaning unit 100 may include a first cleaning unit portion 105 and a second cleaning unit portion 107. The first cleaning unit portion 105 and the second cleaning unit portion 107 may be arranged to defined therebetween a media channel 108. Media such as web 109 may translate through the media channel 108 by way of passageways 101.

As shown in FIG. 1A, related art cleaning members such as stationary animal hair brushes 111 may extend from either or both of the cleaning unit first portion 105 and the cleaning unit second portion 107. Brushes 111 may be arranged with a grounding plate 112. Brushes 111 may extend from, for example, the first portion 105 toward the media channel 108. Brushes 111 may be positioned to contact the web 109, translatable within the media channel 108.

Figure 1B:
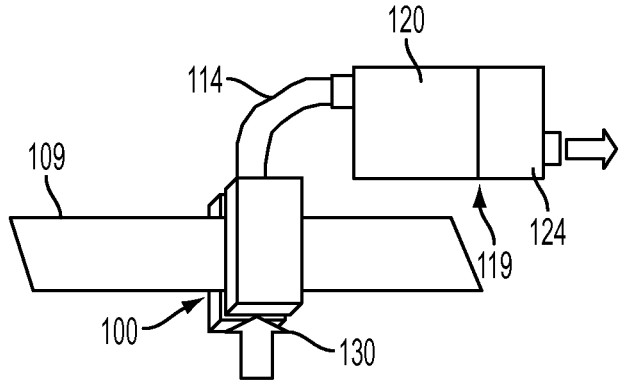
FIG. 1B RELATED ART
FIG. 1B shows a diagrammatical top perspective view of a related art cleaning system including the related art cleaning unit of FIG. 1A.

As shown in FIG. 1B, cleaning unit 100 may be associated with a vacuum and/or air flow system 119, or other device or system suitable for removing loose debris, to form a cleaning system. For example, FIG. 1B shows a flexible hose 114 connecting the cleaning unit 100 to air filter 120, which may include coarse and fine filters. The air filter 120 may be associated with a blower 124. Air flow system 119 may generate cross-web air flow 130. The cross web air flow 130 may carry debris from the web 109 through flexible hose 114 to air filter 120. Blower 124 may provide suction for air flow. Alternatively, air flow may be provided by another means.

Conductive cleaning members, e.g., conductive electrostatic brushes, enhance cleaning performance over related art cleaning members, particularly for printed media applications, i.e., for cleaning media after printing. An electric field created by a conductive brush and an opposing conductive backing member, or a conductive brush and a triboelectrically charged web. The electric field may influence unfused toner particles on the surface of the printed web. For example, a backing member that extends from a first cleaning unit portion may be electrically biased while an opposing cleaning member that extends from a second cleaning unit portion is grounded. Alternatively, the cleaning member may be electrically biased while the opposing backing member is electrically biased.

Figure 2:
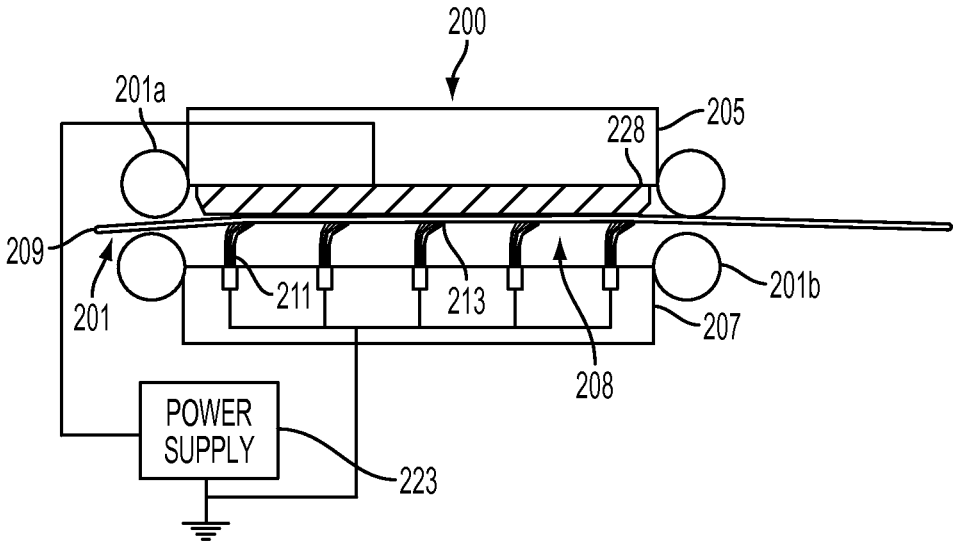
FIG. 2 shows a diagrammatical side view of a cleaning unit in accordance with an exemplary embodiment.

In embodiments, a cleaning system may include a cleaning unit 200 as shown in FIG. 2, in which a backing member may be electrically biased while an opposing cleaning member may be grounded. The cleaning unit 200 may include media passageways 201 defined by rolls 201*a* and rolls 201*b*. Although rolls are shown, any rotatable member suitable for accommodating translation of media through the cleaning unit 200 may be implemented. Alternatively, smooth skid surfaces may be implemented such that the printed media slides across the skid surface with little or no damage to the printed surface of the media. The cleaning unit 200 may include a first cleaning unit portion 205 and a second cleaning unit portion 207. The first cleaning unit portion 205 and the second cleaning unit portion 207 may be arranged to defined therebetween a media channel 208. Media such as web 209 may translate through the media channel 208 by way of passageways 201.

As shown in FIG. 2, conductive cleaning members such as brushes 211 may extend from the cleaning unit second portion 207. Although brushes are shown, other materials or structure suitable for cleaning media may be implemented, such as conductive foam pads and low pile height conductive fiber cloth or other conductive fabric backed by an elastic material to bring it into contact with the media The brushes 211 may extend toward the media channel 208. The brushes 211 may be positioned to contact the web 209 within the media channel 208 at a contact point 213, as the web 209 translates through the media channel 208 of the cleaning unit 200. The media to be cleaned may be a paper web, a plastic film web or any other web media suitable for printing.

The brushes 211 are conductive brushes. For example, brushes 211 may be electrostatic brushes of high conductivity or low conductivity. A preferred exemplary high conductivity fiber resistance for brushes 211 may be less than $10^{12}$ Ω/cm. Exemplary low conductivity fiber resistances may include $10^{12}$ to $10^{15}$ Ω/cm. FIG. 2 shows brushes 211 that are grounded. In alternative embodiments, however, brushes 211 may be connected to a power supply 223, and electrically biased to create an electric field with an opposing backing member or a triboelectrically charged web.

As shown in FIG. 2, cleaning unit 200 may include a backing member such as conductive metal plate 228. Although the conductive metal plate 228 is shown, the backing member may be any structure suitable for creating an electric field with an opposing cleaning member. For example, the backing member may be a conductive pile carpet, a foam backed conductive fabric or sheet, or a conductive ceramic coated roll or plate. An electric field may be established by applying electrical bias to the backing member or the cleaning member.

The conductive metal plate 228 may extend from the cleaning unit first portion 205, toward the media channel 208, and may be positioned opposite from the brushes 211 that extend from the second portion 207.

In embodiments, the conductive metal plate 228 may be composed of stainless steel or other low wear conductive material. In alternative embodiments, the metal plate 228 may be composed of any material suitable for use as a backing member, and having appropriate conductivity. Exemplary backing members may be composed of hard anodized aluminum, controlled conductivity ceramic coated steel, aluminum or other suitable metal. Ceramic coatings can be chosen from a group of materials consisting of alumina, zirconia, thoria, beryllia, magnesia, spinel, silica, titania, and forsterite.

Because the brushes 211 and the metal plate 228 may, in some embodiments, be wider than the web that translates through the cleaning unit 200, various arrangements are preferred for preventing shorting between the cleaning member and the backing member where the web is not present. For example, brushes 211 may be grounded, high conductivity fibers, and the metal plate 228 may have a dielectric coating and be electrically biased. Alternatively, brushes 211 may be electrically biased and may include low conductivity fibers, and the high conductivity metal plate 228 may be grounded.

The conductive metal plate 228 may include a dielectric coating, and may be connected to the power supply 223. Exemplary backing members having a dielectric coating may have a conductivity of, e.g., less than $10^{-8}$ $(\Omega\text{-cm})^{-1}$. Other acceptable conductivity may include values in the range of $10^{-15}$ to $10^{-8}$ $(\Omega\text{-cm})^{-1}$.

As the printed and fused web 209 translates through the media channel 208, debris having electrostatic charge may be attracted to the brushes 211 or repelled therefrom, depending on the electric field applied to the web 209 in the medial channel 208. To generate an electric field, the metal plate 228 may be connected to the power supply 223 and electrically biased as shown in FIG. 2, while the conductive brushes 211 are grounded. The web 209 may be translated through the cleaning unit 200 to apply the electric field to the web while brushes 211 contact the web 209. In alternative embodiments, the conductive metal plate 228 may be grounded, while the brushes 211 are electrically biased.

Figure 3A:
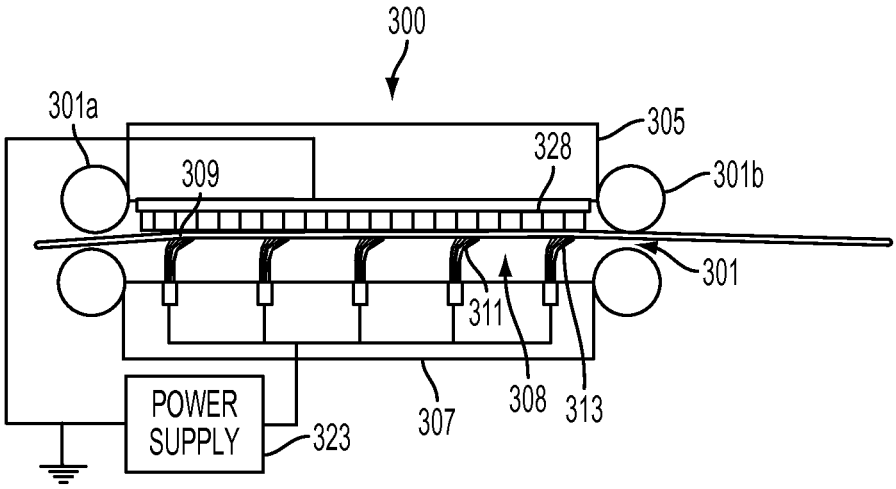
FIG. 3 shows a diagrammatical side view of a cleaning unit in accordance with an exemplary embodiment.
Figure 3B:
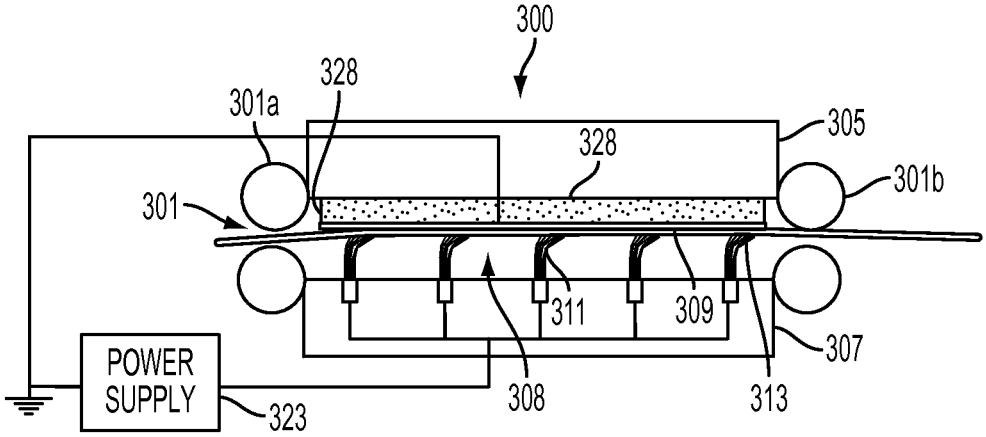

In embodiments, a cleaning system as shown in FIGS. 3A and 3B may include a cleaning unit 300 having a conductive cleaning member that is electrically biased and an opposing backing member that is grounded. Alternatively, the backing member may be electrically biased, and the cleaning member may be grounded. Specifically, the cleaning unit 300 may include media passageways 301 defined by passageway rolls 301*a* and passageway rolls 301*b*. The cleaning unit 300 may include a first cleaning unit portion 305 and a second cleaning unit portion 307. The first cleaning unit portion 305 and the second cleaning portion 307 may be arranged to define therebetween a media channel 308. Media such as web 309 may translate through the media channel 308 by way of passageways 301. The media may be a paper web, or other printable media.

The cleaning unit 300 may include conductive brushes 311 composed of, e.g., low conductivity fiber 313. The brushes 311 may alternatively be composed of high conductivity fiber. The brushes 311 may be connected to a power supply 323, and may be electrically biased. In alternative embodiments, the brushes 311 may be grounded and positioned to oppose a backing member, which may be connected to the power supply 323 and electrically biased.

The cleaning unit 300 may also include a grounded conductive fiber pile carpet 328 that forms the backing member shown in FIG. 3A. The backing member may alternatively be grounded. The fiber pile carpet 328 may be formed of knit or woven fabric having high or low conductivity fibers. The conductive fiber pile carpet 328 may extend from the first cleaning unit portion 305, toward the media channel 308, and may be positioned opposite to the brushes 311, which extend from the second cleaning unit portion 307. Accordingly, an electric field may be applied to the media channel 308, by way of the grounded fiber pile carpet 328 and the electrically biased brushes 311.

In embodiments, the backing member may have other forms, such as a grounded conductive flexible sheet 328, as shown in FIG. 3B. The flexible sheet 328 may be formed of knit or woven fabric having high or low conductivity fibers. Alternatively, the flexible sheet 328 may be formed of other flexible, conductive materials, such as a metalized polymer (e.g., aluminized mylar), a metal foil, a polymer laminate, or a thin metal sheet. The flexible sheet 328 may include an elastic backing.

The conductive flexible sheet 328 may extend from the first cleaning unit portion 305, toward the media channel 308, and may be positioned to oppose the brushes 311, which extend from the second cleaning unit portion 307 toward the media channel 308. Accordingly, an electric field may be applied across the media channel 308, by way of the grounded conductive flexible sheet 328 and the electrically biased electrostatic brushes 311.

Figure 4:
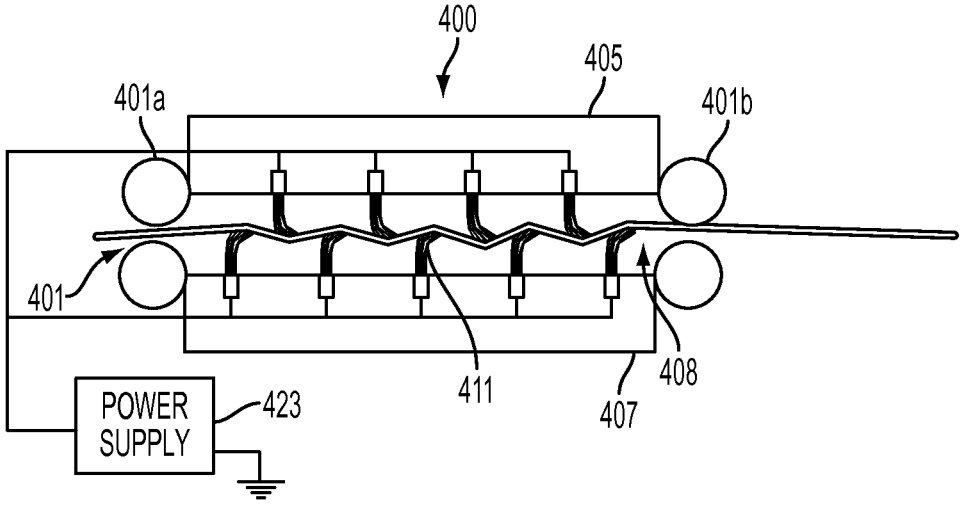
FIG. 4 shows a diagrammatical side view of a cleaning unit in accordance with an exemplary embodiment.

In embodiments, a cleaning system as shown in FIG. 4 includes a cleaning unit 400 having a first cleaning member that is electrically biased and a second cleaning member that opposes the first cleaning member, which also may be electrically biased. Specifically, the cleaning unit 400 may include media passageways 401 defined by translatable members such as rolls 401*a* and rolls 401*b*. The cleaning unit 400 may include a first cleaning unit portion 405 and a second cleaning unit portion 407. The first cleaning unit portion 405 and the second cleaning portion 407 may be arranged to define therebetween a media channel 408. Media such as web 409 may translate through the media channel 408 by way of passageways 401.

A first cleaning member extending from the first portion 405 may include brushes 411, which may be composed of high conductivity fiber. The first cleaning member may extend from the first portion 405 towards the media channel 408. A second cleaning member extending from the second portion 407 may include brushes 411, and may be positioned opposite to the first cleaning member extending from the first portion 405, the media channel interposing the first portion 405 and the second portion 407. Either or both of the first cleaning member and the second cleaning member may be connected to a power supply 423, and may be electrically biased.

The cleaning unit 400 may create an electric field between biased conductive cleaning members and a triboelectrically charged web, and the charged particles adhered to the web. Accordingly, the brushes 411 may be highly conductive to accommodate brush bias at the fiber tibs of brushes 411, without a long time constant. Because the electric field created between the web 408 and the brushes 411 is not actively controlled with a conductive backing member opposing the brushes 411, the bias required for effective cleaning may be difficult to predict. The electric field is influence by the triboelectric charge on the web 409, the electric charge on unfused toner and other particles adhered to the web 409, and the triboelectric charge of the tips of brushes 411. These parameters may be varied based on the triboelectric and resistance properties of brush fibers or other cleaning member, media properties, toner type, environmental conditions, and contamination.

The above-described embodiments improve cleaning member performance by attracting and retaining unfused toner particles and other charged debris, or repelling such particles and debris, using conductive cleaning members to apply an electric field to a web during cleaning. Conductive cleaning members of embodiments exhibit improved cleaning performance over related art cleaning members. For example, FIG. 5 shows web cleaner test results comparing cleaning effectiveness of biased conductive brushes and related art animal brushes.

In the web cleaner test, various surfaces in the subject web printing system, located downstream of test cleaning members, were identified as high toner accumulation areas from which accumulated toner contamination could easily be collected. During testing, the accumulated toner was removed from the identified surfaces using a vacuum nozzle. The removed toner was collected in a small pore filter. Filter weights were taken before and after collection to determine the mass of toner accumulated on the located surface for each of the different cleaning member test runs. The filter was contained within a Faraday cage connected to an electrometer. The electrometer measured the accumulated charge on the toner collected within the filter. Toner charge measurements for each of the cleaning member test runs were relatively low at about +6 μC/g.

Figure 5:
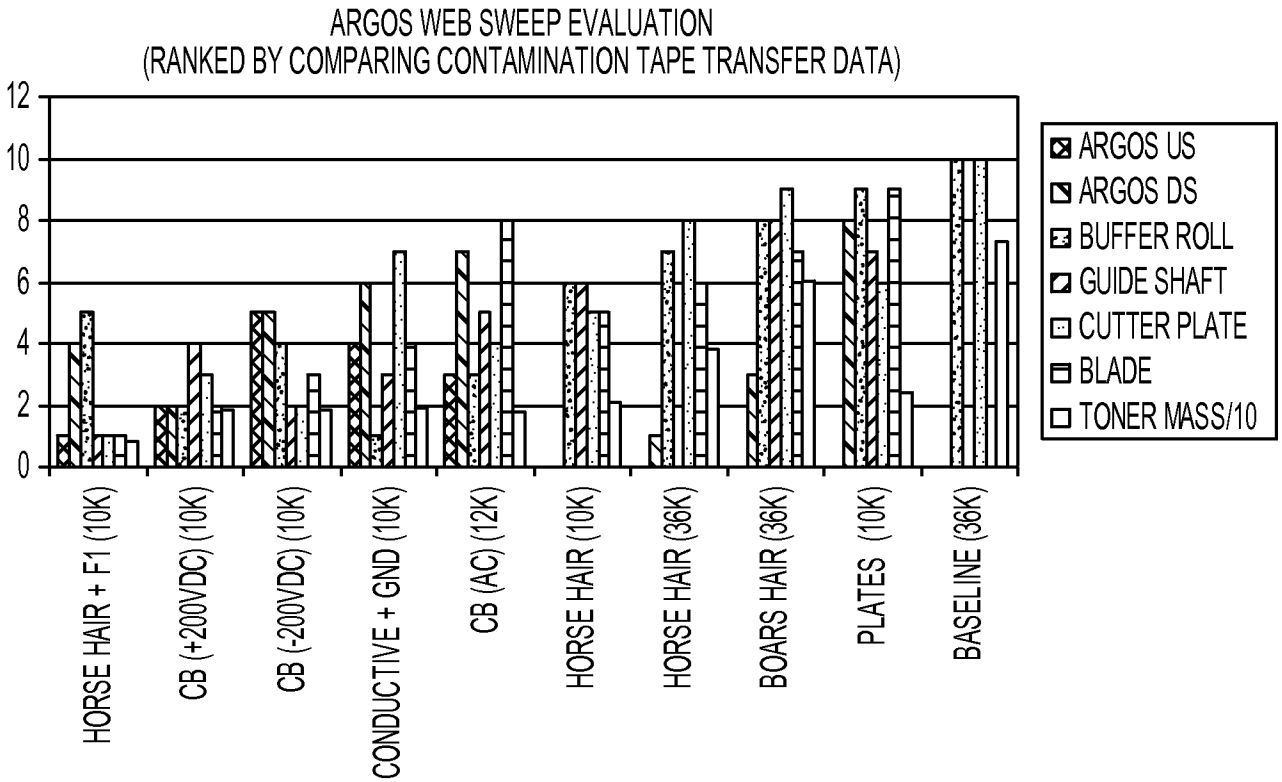
FIG. 5 shows a chart comparing cleaning performance of animal hair brushes and conductive electrostatic brushes in accordance with an exemplary embodiment.

FIG. 5 shows that cleaning members such as conductive brushes yielded improved performance over animal hair brushes for all tested bias options: +200 VDC, −200 VDC, +200 AC, and OV, i.e., grounded. Preferred results of the web cleaner test occurred for conductive brushes biased at +200 VDC. This may suggest that cleaning performance is enhanced by embodiments wherein positively charged toner particles are repelled from the cleaning member. Repulsion of charged toner particles prevents excessive build-up of toner within the cleaning member, e.g., the brushes. Repulsion of positively charged toner particles also enhances effective disturbance of toner particles on the printed web by using electrostatic repulsion in addition to mechanical disturbance to break toner adhesion to the printed web so that air flow can transport unfused toner particles and other debris.

Figure 6:
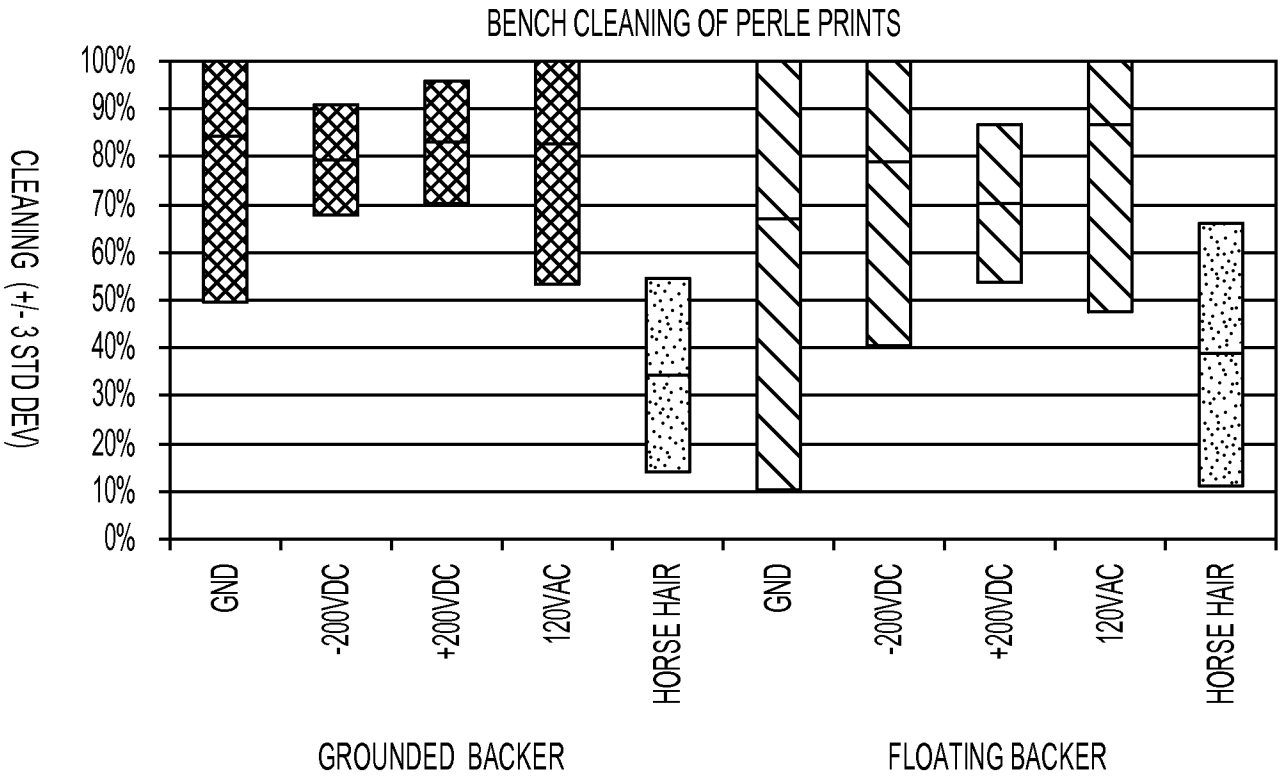
FIG. 6 shows a chart comparing cleaning effectiveness of various cleaning member parameters.

The results of a test for cleaning of prints to determine cleaning effectiveness for tested brush conditions are shown in FIG. 6. Specifically, a cleaning system having a conductive cleaning member and a backing member was tested. Bias options for the cleaning member were tested for both a grounded backing member and a floating backing member. Conductive fiber brushes and horse hair brushes were tested.

The test results show that test prints were cleaned with a single pass of a brush over the print. The print was then examined to evaluate cleaning. Fiducial marks were placed on the print so that before and after cleaning, photomicrographs could be compared, and the percentage of background toner particles removed could be quantified. The test results show improved cleaning performance for conductive brushes, and particularly electrically biased conductive brushes. The test results also show improved cleaning performance for cleaning systems having a conductive cleaning member and grounded backing member, rather than a floating backing member.

While methods, apparatus, and systems for cleaning media with conductive cleaning members is described in relationship to exemplary embodiments, many alternatives, modifications, and variations would be apparent to those skilled in the art. Accordingly, embodiments of the methods, apparatus, and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A method for cleaning a web in a web printing system having a cleaning unit, the cleaning unit including a first portion and a second portion that together define a web channel, and at least one conductive cleaning member that extends from at least one of the first portion and the second portion toward the web channel, the web including a printable surface and being translatable through the web channel, the method comprising:

applying power to the at least one conductive cleaning member and a backing member to electrically bias the at least one conductive cleaning member and the backing member;

applying the at least one conductive cleaning member to the printable surface of the web to clean the web, wherein the backing member is a conductive fiber pile carpet.

2. The method of claim 1, further comprising:

attracting electrostatically charged toner particles to the at least one conductive cleaning member.

3. The method of claim 2, further comprising:

retaining the electrostatically charged toner particles on the at least one conductive cleaning member.

4. The method of claim 1, wherein the at least conductive one cleaning member is a first conductive cleaning member, and the cleaning unit includes a second conductive cleaning member that extends from at least one of the first portion and the second portion, the method further comprising:

applying power to the second conductive cleaning member to electrically bias the second conductive cleaning member.

5. A web cleaning apparatus for cleaning a web having a first side and a second side, the apparatus comprising:

a cleaning system including a first portion and a second portion, the first portion being located opposite from the second portion to define a web channel, the web being translatable through the web channel;

at least one conductive cleaning member, the cleaning member being constructed and arranged to form an electric field for cleaning at least one of the first side and the second side of the web, the at least one conductive cleaning member extending from the cleaning system second portion toward the web channel; and a backing member, the backing member extending from the cleaning system first portion toward the web channel and opposing the cleaning member, wherein the backing member is a conductive fiber pile carpet.

6. The web cleaning apparatus of claim 5, wherein the at least one conductive cleaning member is an electrostatic brush.

7. The apparatus of claim 5, wherein the at least one conductive cleaning member is electrically biased to attract charged toner particles.

8. The apparatus of claim 5, wherein the at least one conductive cleaning member is electrically biased to repel charged toner particles.

9. The web cleaning apparatus of claim 5, wherein the backing member is connected to a power supply, the backing member being electrically biased, and forming an electric field together with the at least one conductive cleaning member.

10. The apparatus of claim 5, wherein the at least one conductive cleaning member is electrically biased, the at least one conductive cleaning member being connected to a power supply.

11. The apparatus of claim 5, wherein the at least one conductive cleaning member is an electrostatic brush.

12. The apparatus of claim 5, the apparatus comprising:

at least one of a vacuum and a high flow air jet for cleaning the web.

13. A web cleaning system, the system comprising:

a web cleaning means for cleaning a web, the web cleaning means including at least one conductive cleaning member;

a biasing means for electrically biasing the at least one conductive cleaning member and a conductive backing member to form an electric field, wherein the conductive backing member is a conductive fiber pile carpet; and a web translation means for moving the web against the electrically biased electrostatic cleaning member.

14. The web cleaning system of claim 13, further comprising:

a debris removal means associated with the web cleaning means, the debris removal means for at least one of vacuuming and blowing debris from the web.

* * * * *